US010106359B2

(12) United States Patent
Kamata et al.

(10) Patent No.: US 10,106,359 B2
(45) Date of Patent: Oct. 23, 2018

(54) SHEET POST-PROCESSING APPARATUS

(71) Applicants: KABUSHIKI KAISHA TOSHIBA, Tokyo (JP); TOSHIBA TEC KABUSHIKI KAISHA, Tokyo (JP)

(72) Inventors: Kimie Kamata, Sunto Shizuoka (JP); Toshiaki Oshiro, Izu Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/906,259

(22) Filed: Feb. 27, 2018

(65) Prior Publication Data

US 2018/0186591 A1 Jul. 5, 2018

Related U.S. Application Data

(62) Division of application No. 15/392,706, filed on Dec. 28, 2016, now Pat. No. 9,919,892.

(51) Int. Cl.

| | |
|---|---|
| ***B65H 31/36*** | (2006.01) |
| ***B65H 31/30*** | (2006.01) |
| ***B65H 31/34*** | (2006.01) |
| ***B65H 37/04*** | (2006.01) |
| ***B65H 43/06*** | (2006.01) |
| ***B65H 9/10*** | (2006.01) |

(52) U.S. Cl.

CPC ..... *B65H 31/3081* (2013.01); *B65H 9/101* (2013.01); *B65H 31/34* (2013.01); *B65H 37/04* (2013.01); *B65H 43/06* (2013.01); *B65H 2403/946* (2013.01); *B65H 2404/731* (2013.01); *B65H 2405/1144* (2013.01); *B65H 2513/30* (2013.01); *B65H 2801/27* (2013.01)

(58) Field of Classification Search

None

See application file for complete search history.

(56) References Cited

U.S. PATENT DOCUMENTS

| | | | | |
|---|---|---|---|---|
| 2008/0179809 | A1* | 7/2008 | Kikkawa | B65H 31/3081 270/58.11 |
| 2010/0038846 | A1* | 2/2010 | Baena, Jr. | B65H 1/14 271/162 |
| 2014/0300047 | A1 | 10/2014 | Yamamoto et al. | |
| 2015/0035226 | A1* | 2/2015 | Nishi | B65H 29/125 271/207 |

* cited by examiner

*Primary Examiner* — Prasad V Gokhale

(74) *Attorney, Agent, or Firm* — Patterson & Sheridan, LLP

(57) ABSTRACT

A sheet processing apparatus includes a first holding unit configured to hold one or more sheets and movable in a sheet transport direction, a first drive unit configured to move the first holding unit in a first direction along the sheet transport direction, a biasing member that biases the first holding unit in a second direction opposite to the first direction, and an energy storage unit that stores energy discharged from the biasing member.

20 Claims, 7 Drawing Sheets

SHEET POST-PROCESSING APPARATUS

CROSS-REFERENCE TO RELATED APPLICATION

This application is a division of U.S. patent application Ser. No. 15/392,706, filed on Dec. 28, 2016, the entire contents of each of which are incorporated herein by reference.

FIELD

Embodiments described herein relate generally to a sheet post-processing apparatus.

BACKGROUND

Generally, some image forming systems include a sheet post-processing apparatus that performs post-processing on sheets. For example, the sheet post-processing apparatus supports a plurality of sheets stacked on a processing tray. An ejector is disposed on an upstream side of the processing tray in a sheet transport direction. The ejector supports the plurality of sheets on the processing tray. The ejector is fixed to an ejector belt. The ejector belt is rotated by a stepping motor or the like. When the ejector belt rotates, the ejector moves the plurality of sheets to downstream side of the processing side.

In order to move the plurality of sheets to the downstream side, a bundle hook is used together with the ejector. The bundle hook is fixed to a bundle hook belt. When the bundle hook belt rotates, the sheets supported by the ejector are delivered to the bundle hook. The bundle hook transports the sheets downstream of the processing tray.

In order to return the ejector from the downstream side to an original position on the upstream side, a winding spring (biasing member) is used. When the ejector belt moves the ejector in the downstream direction, the winding spring is expanded by a stepping motor. When the winding spring is expanded, elastic energy is stored in the winding spring. When interlocking of the stepping motor and the winding spring is released, the winding spring releases the stored energy. The ejector thus returns to its original position. The elastic energy stored in the winding spring is used to return the ejector to the original position.

DETAILED DESCRIPTION

A sheet processing apparatus of an embodiment includes a first holding unit configured to hold one or more sheets and movable in a sheet transport direction, a first drive unit configured to move the first holding unit in a first direction along the sheet transport direction, a biasing member that biases the first holding unit in a second direction opposite to the first direction, and an energy storage unit that stores energy discharged from the biasing member.

Hereinafter, the sheet post-processing apparatus of the embodiment will be described with reference to the drawings.

Figure 1:
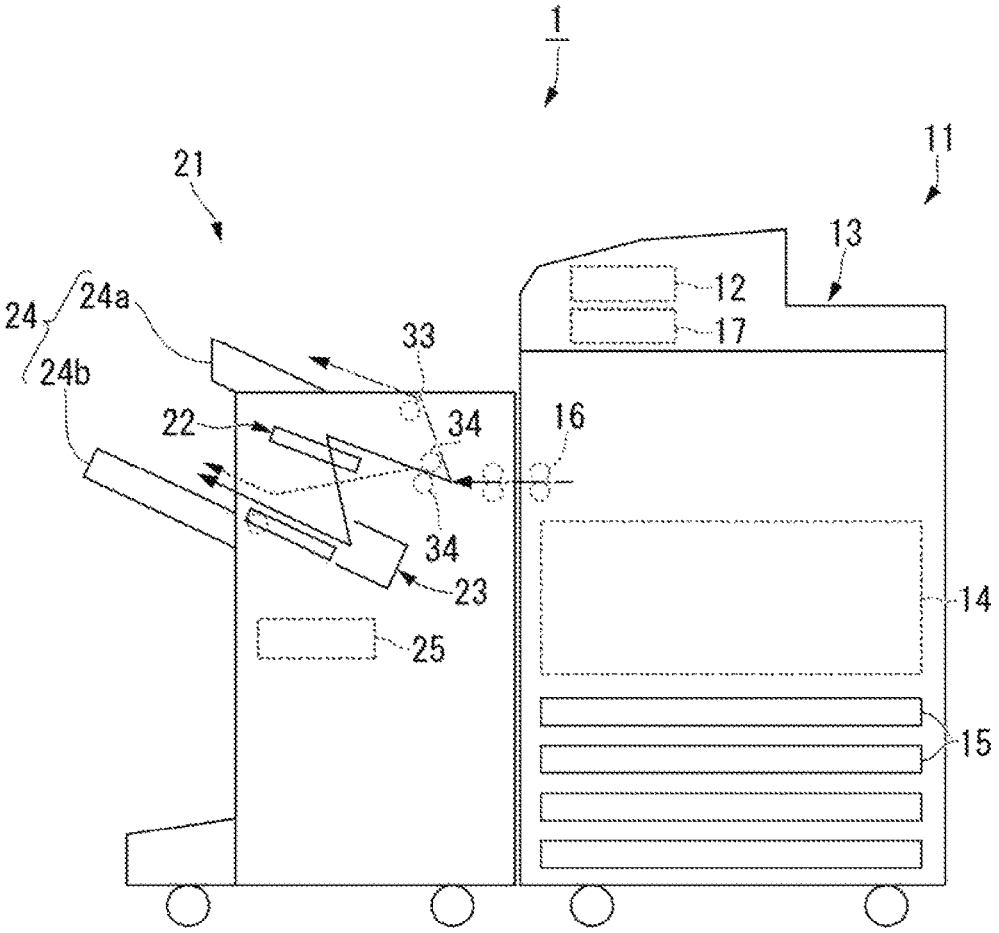
FIG. 1 is a side view schematically illustrating an overall configuration example of an image forming system and sheet post-processing apparatus.
Figure 2:
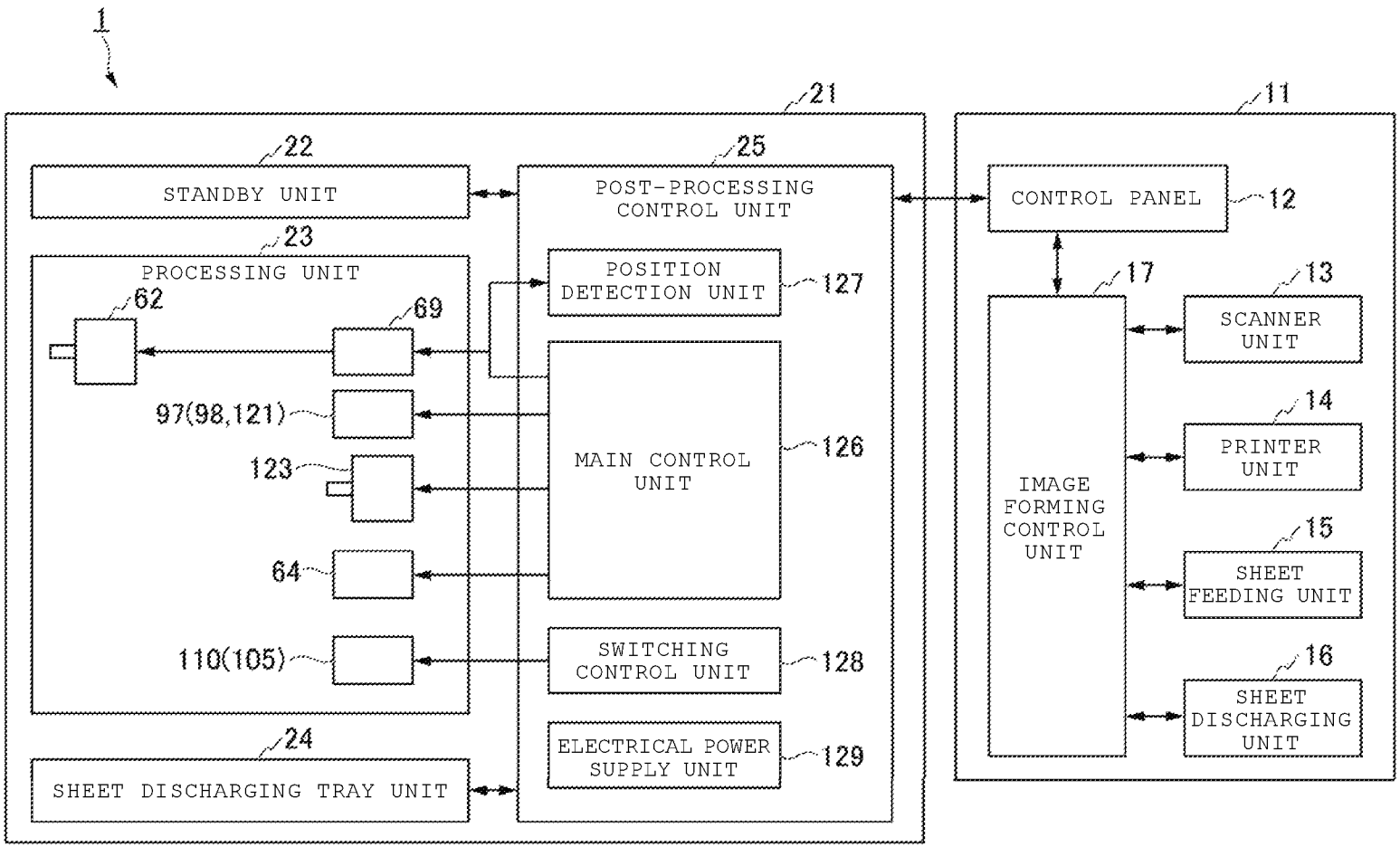
FIG. 2 is a block diagram of the image forming system.

As illustrated in FIG. 1 and FIG. 2, a sheet post-processing apparatus 21 is used in an image forming system 1. The image forming system 1 includes an image forming apparatus 11 and a sheet post-processing apparatus 21.

The image forming apparatus 11 forms an image on a sheet. More particularly, the image forming apparatus 11 includes a control panel 12, a scanner unit 13, a printer unit 14, a sheet feeding unit 15, a sheet discharging unit 16, and an image forming control unit 17.

The control panel 12 includes various keys or touch panel icons for receiving inputs of a user. The control panel 12 sends information or the like relating to the discharge destination of the sheet to the sheet post-processing apparatus 21. The scanner unit 13 includes a reading unit for generating image data corresponding to a copied object. The scanner unit 13 sends the image data to the printer unit 14.

The printer unit 14 forms an output image (hereinafter, referred to as "toner image") using a developer such as toner and the like. The toner image is formed based on the image data transmitted from the scanner unit 13 or from an external device.

The sheet feeding unit 15 supplies sheets to the printer unit 14 one by one, in accordance with a time during which the printer unit 14 is ready to form a toner image on a sheet.

The sheet discharging unit 16 transports sheets discharged from the printer unit 14 to the sheet post-processing apparatus 21.

The image forming control unit 17 controls the entirety of operations of the image forming apparatus 11. That is, the image forming control unit 17 controls the control panel 12, the scanner unit 13, the printer unit 14, the sheet feeding unit 15, and the sheet discharging unit 16. For example, the image forming control unit 17 is configured with a control circuit including a central processing unit (CPU), a random access memory (RAM), and the like.

Next, the sheet post-processing apparatus 21 will be described.

The sheet post-processing apparatus 21 is arranged in the vicinity of the image forming apparatus 11. The sheet post-processing apparatus 21 performs processing on the sheets transported from the image forming apparatus 11 based on instructions input through the control panel 12. The sheet post-processing apparatus 21 includes a standby unit 22, a processing unit 23, a sheet discharging tray unit 24, and a post-processing control unit 25.

The standby unit 22 temporarily holds the sheets transported from the image forming apparatus 11. For example, the standby unit 22 holds a subsequently processed plurality of sheets, while post-processing on previously processed sheets is performed in the processing unit 23. The standby unit 22 drops the sheets that it held into the processing unit 23 when the processing unit 23 is free.

The processing unit 23 performs the post-processing on the sheets. The post-processing includes processes such as a sorting process, a stapling process, or the like. For example, the processing unit 23 aligns the plurality of sheets. The processing unit 23 then performs stapling on the aligned plurality of sheets. The processing unit 23 then discharges the sheets on which the post-processing is performed to the sheet discharging tray unit 24.

The sheet discharging tray unit 24 includes a fixed tray 24*a* and a movable tray 24*b*. The fixed tray 24*a* is provided on an upper portion of the sheet post-processing apparatus 21. Meanwhile, the movable tray 24*b* is provided on a side portion of the sheet post-processing apparatus 21. The movable tray 24*b* can be moved in a vertical direction along the side portion of the sheet post-processing apparatus 21. A sheet is discharged to the fixed tray 24*a* or the movable tray 24*b* according to the discharge destination of a sheet selected through the control panel 12.

Next, a configuration of each unit of the sheet post-processing apparatus 21 will be described in detail.

In the following description, the "upstream side" and the "downstream side" refer to a transportation direction of a sheet S illustrated in FIG. 3, respectively.

Figure 3:
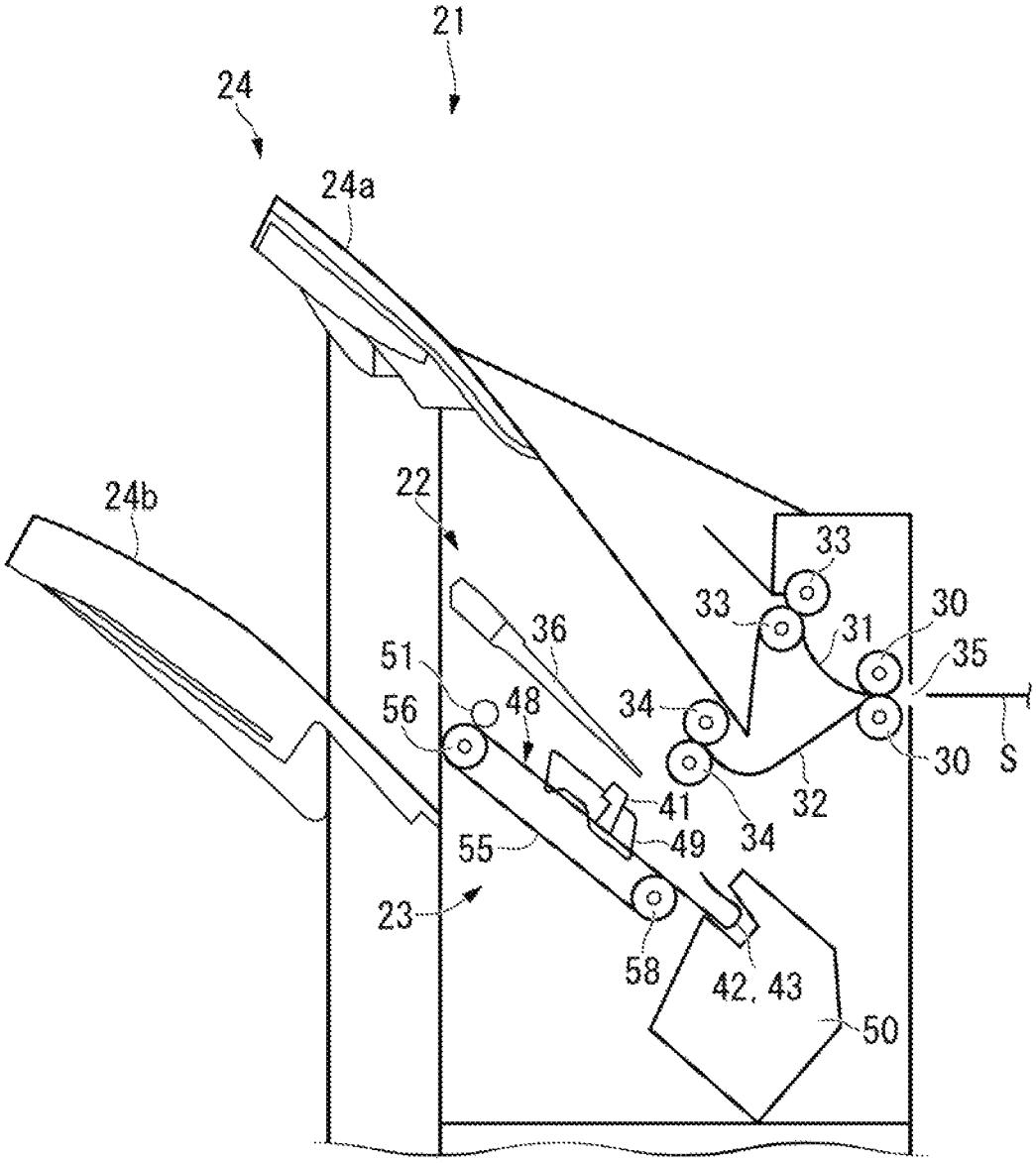
FIG. 3 is a side view schematically illustrating the sheet post-processing apparatus of the embodiment.

As illustrated in FIG. 3, the sheet post-processing apparatus 21 includes an inlet roller 30, transportation paths 31 and 32 of the sheet S, a discharge roller 33, and an outlet roller 34.

The inlet roller 30 is provided near a sheet supply port 35 of the sheet post-processing apparatus 21. The inlet roller 30 transports the sheet S supplied to the sheet supply port 35 toward the inside of the sheet post-processing apparatus 21.

The transportation paths 31 and 32 include a first transportation path 31 and a second transportation path 32. The first transportation path 31 is provided between the inlet roller 30 and the fixed tray 24*a* of the sheet discharging tray unit 24. The discharge roller 33 is provided in an end portion of the downstream side of the first transportation path 31. The discharge roller 33 discharges the sheet S transported through the first transportation path 31 toward the fixed tray 24*a*.

Meanwhile, the second transportation path 32 is provided between the inlet roller 30 and the outlet roller 34. The outlet roller 34 is provided in an end portion of the downstream side of the second transportation path 32. For example, the outlet roller 34 transports the sheet S transported through the second transportation path 32 toward the standby unit 22.

The standby unit 22 includes a pair of standby trays 36 opposed from one another in a direction orthogonal to the discharge path of a sheet (one standby tray 36 is not illustrated) and an opening and closing drive unit (not illustrated). The pair of standby trays 36 is disposed in parallel with a width direction of the sheet S perpendicular to (intersecting) the transportation direction of the sheet S. An end portion of the upstream side of each standby tray 36 is positioned slightly below an outlet of the second transportation path 32. The sheet S is transported from the second transportation path 32 to the pair of standby trays 36. The pair of standby trays 36 temporarily hold a plurality of sheets S by allowing sheets to be stacked thereon, while the post-processing is performed on other sheets in the processing unit 23. A processing tray 48 to be described below of the processing unit 23 is disposed in a downward position with respect to the pair of standby trays 36.

The opening and closing drive unit can move the pair of standby trays 36 in the width direction. When the pair of standby trays 36 are close to each other in the width direction, the plurality of sheets S are supported on the pair of standby trays 36. When the pair of standby trays 36 are moved away from each other in the width direction, the plurality of sheets S supported on the standby tray 36 move (drop) to the processing tray 48.

Figure 4:
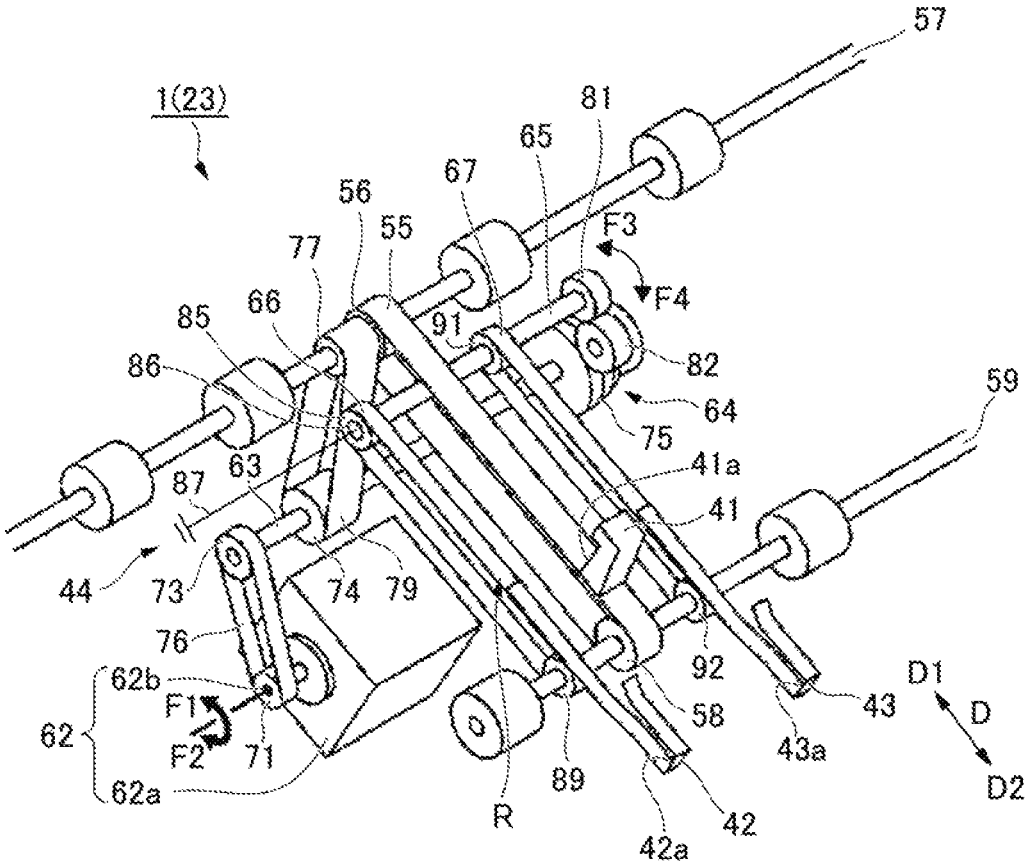
FIG. 4 is a perspective view schematically illustrating a main part of a processing unit of the post processing apparatus of the embodiment.
Figure 5:
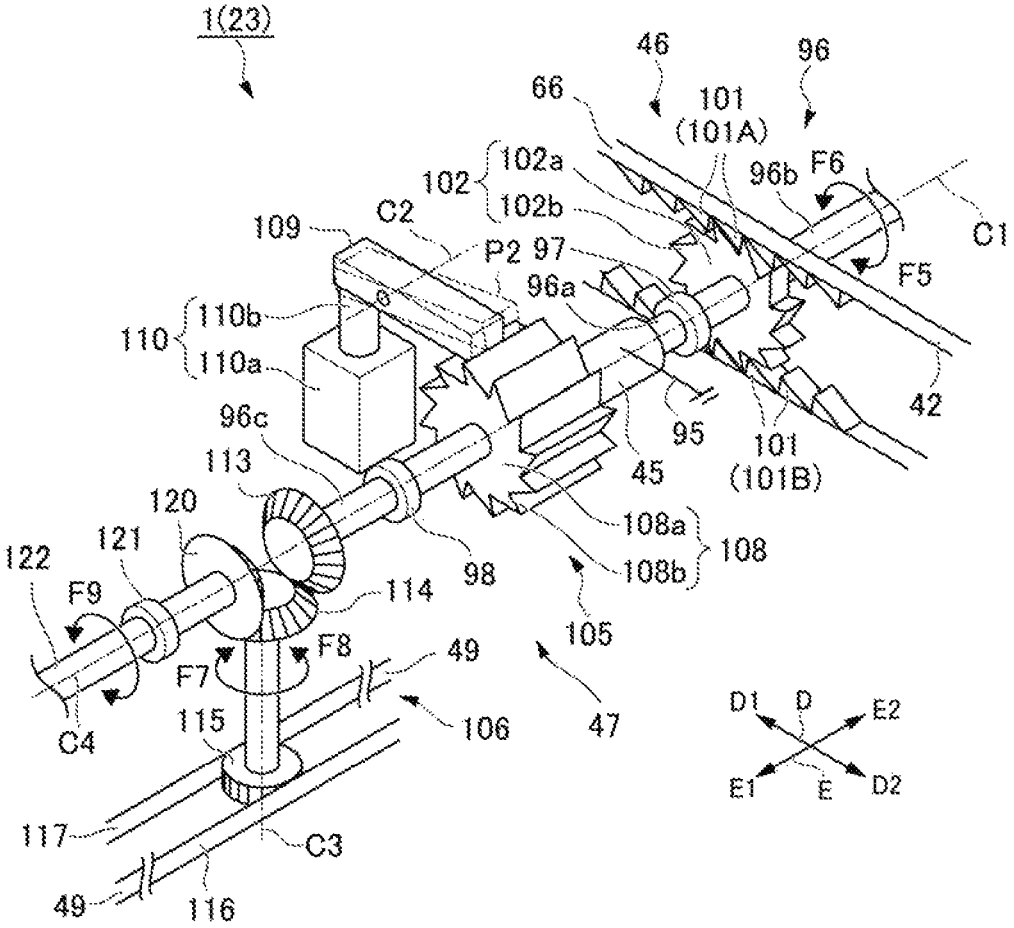
FIG. 5 is a perspective view of a second switching unit and a second drive unit of the post processing apparatus of the embodiment.

As illustrated from FIG. 3 to FIG. 5, a processing unit 23 includes a bundle hook (second holding unit) 41, a pair of ejectors (first holding unit) 42 and 43, a first drive unit 44, a coil spring (energy storage unit) 45, a second switching unit 46, a second drive unit 47, a processing tray 48, a pair of lateral alignment plates (moving objects) 49, a stapler 50, and a discharge roller 51.

For the convenience of description, the coil spring 45, the second switching unit 46, the second drive unit 47, the processing tray 48, and the like are not illustrated in FIG. 4.

For example, a concave portion 41*a* for holding the plurality of sheets S is formed in the bundle hook 41. The bundle hook 41 is fixed to a bundle hook belt 55. The bundle hook belt 55 is a continuous belt maintained in an annular shape in which a transportation direction D of the sheet S is the major axis. The bundle hook 41 is fixed to an outer periphery surface of the bundle hook belt 55.

The end portion of the bundle hook belt 55 in the first direction D1 located on the downstream side of the sheet S position is wound (passed) around a roller 56. The roller 56 rotates upon rotation of a first support shaft 57 to which it is connected. The end portion of the bundle hook belt 55 in a second direction D2 located on the on the upstream side of the sheet S location is wound around a roller 58. The roller 58 rotates with a second support shaft 59. The first direction D1 and the second direction D2 define directions along the transportation direction D of a sheet, with D1 being the forward direction of sheet travel. The second direction D2 is a direction opposite to the first direction D1.

The support shafts 57 and 59, a third support shaft 63, and a fourth support shaft 65 described below extend in the width direction of a sheet, which is generally orthogonal to the transportation direction of a sheet. The support shafts 57, 59, 63, and 65 are supported at their opposed ends by the frame (not illustrated) or the like of the sheet post-processing apparatus 21.

The ejectors 42 and 43 are located to either side of the bundle hook 41 in the width direction. A concave portion 42*a* or 43*a*, for securing the plurality of sheets S, is formed in each of the ejectors 42 and 43.

The first drive unit 44 includes a drive motor (power generating unit) 62, the third support shaft 63, a clutch mechanism (first switching unit) 64, the fourth support shaft 65, and ejector belts 66 and 67.

In the embodiment, the drive motor 62 is a stepper motor. For example, when a pulse signal which is generated from a motor driver 69 (see FIG. 2) is input to the drive motor 62*b*, the drive motor 62 is driven to rotate drive shaft 62*b* based on the number of pulses.

The drive motor 62 includes a motor main body 62*a* and a drive shaft 62*b* which rotates around an axis line with respect to the motor main body 62*a*. The motor main body 62*a* is fixed to the frame or the like of the sheet post-processing apparatus 21. When the drive motor 62 is driven, the drive shaft 62*b* rotates with respect to the motor main body 62*a*. The drive motor 62 can rotate the drive shaft 62*b* in a desired direction such as either direction F1 or direction F2 around an axis.

A roller 71 is fixed to the drive shaft 62*b*.

A pulse signal generated from the motor driver 69 is sent not only to the drive motor 62, but also to the post-processing control unit 25.

Rollers 73, 74, and 75 are fixed to the third support shaft 63. The rollers 73, 74, and 75 are fixed in order in a longitudinal direction of the third support shaft 63. A drive belt 76 extends over the roller 71 of the drive motor 62 and the roller 73 of the third support shaft 63. The first support shaft 57 supports a roller 77. The roller 77 can rotate around the first support shaft 57. The roller 77 is fixed to the roller 56. The rollers 56 and 77 are interconnected to integrally rotate around the first support shaft 57. An annular drive belt 79 is wound over the roller 74 of the third support shaft 63 and the roller 77 of the first support shaft 57.

A clutch mechanism 64 includes a roller 81 fixed to the fourth support shaft 65, the above-mentioned roller 75, a switching roller 82, and a movement mechanism (not illustrated). The movement mechanism has a known configuration, and causes the switching roller 82 to simultaneously contact the rollers 75 and 81, or separate from the rollers 75 and 81 to isolate the switching roller 82 from the rollers 75 and 81.

The movement mechanism selectively causes the switching roller 82 to come into contact with the rollers 75 and 81. By interlocking contact of the switching roller 82 with both the roller 75 and the roller 81, rotation of the roller 75 causes the switching roller 82 and the roller 81 to rotate. As described below, the clutch mechanism 64 includes a power interlocking state in which the drive motor 62 and the ejectors 42 and 43 are interlocked with each other. Additionally, the movement mechanism of the clutch can separate the switching roller 82 from the rollers 75 and 81, and in this state, when the roller 75 rotates, the roller 81 does not rotate. As described below, the clutch mechanism 64 has a power release state in which the interlocking of the drive motor 62 and the ejectors 42 and 43 is released.

The clutch mechanism 64 is selectively switched to one of the power interlocking state and the power release state.

The ejector belts 66 and 67 are formed in an elongated annular shape in which the transportation direction D is the major axis. In the first direction D1, the ejector belt 66 is wound over roller 85. The roller 85 is fixed to the fourth support shaft 65.

A winding spring (biasing member) 86 is disposed between the fourth support shaft 65 and the roller 85. A first end portion of the winding spring 86 is fixed to the frame or the like of the sheet post-processing apparatus 21 by a connection member 87. A second end portion of the winding spring 86 is fixed to the roller 85. The winding spring 86 may be a flat piece of spring metal coiled into a coil spring configuration In the second direction D2 the ejector belt 66 is wound around a roller 89. The roller 89 can rotate around the second support shaft 59. An ejector 42 is fixed to the outer periphery surface of the ejector belt 66 on an upwardly facing portion thereof. The ejector belt 67 is wound around a roller 91 in the first direction D1. The roller 91 is fixed to the fourth support shaft 65. The ejector belt 67 is wound around a roller 92 in the second direction D2. The roller 92 can rotate around the second support shaft 59. The ejector 43 is fixed to an upwardly facing surface of an outer periphery surface of the ejector belt 67.

As illustrated in FIG. 4, the transportation path R through which the sheet S is transported in the processing unit 23 includes the upwardly facing surfaces of the bundle hook belt 55 and ejector belts 66 and 67.

The bundle hook 41, the ejectors 42 and 43, and the winding spring 86 configured in this manner operate as follows.

As described below, when the clutch mechanism 64 is in a power interlocking state, the drive motor 62 integrally rotates the fourth support shaft 65 and the rollers 85 and 91 fixed thereto in the rotation direction F3 around the axis of the fourth support shaft 65. The ejectors 42 and 43 thus move in the first direction D1 along with the ejector belts 66 and 67. The winding spring 86 is resultantly wound tight, and elastic energy (energy) is accumulated in the winding spring 86. As the first drive unit 44 moves the ejectors 42 and 43 in the first direction D1, the bundle hook 41 starts movement from a retracted position P1, that is a position on a downwardly facing surface of the bundle hook belt 55, illustrated in FIG. 6. The retracted position P1 is a position deviated (retracted) from the transportation path R. As described below, when the third support shaft 63 is rotated by the drive motor 62, the bundle hook 41 is first moved by the bundle hook belt 55 in the second direction D2 from the retracted position P1 on the underside portion of the bundle hook belt 55. The bundle hook 41 is then moved by the bundle hook belt 55 past the position of the roller 58. The bundle hook 41 thereafter moves in the first direction D1 within a predetermined range of a transportation direction D on the transportation path R.

When the clutch mechanism 64 is in the power release state, the winding spring 86 discharges the accumulated elastic energy stored therein. When this occurs, the fourth support shaft 65 rotates in the direction F4. As a result, the ejectors 42 and 43 are moved by the ejector belts 66, 67 in the second direction D2. The winding spring 86, when released, thus biases the ejectors 42 and 43 in the second direction D2.

The ejectors 42 and 43 are moved within a predetermined range in the transportation direction D on the upwardly facing surface of the ejector belts 66 and 67. The end of the movement range of the ejectors 42 and 43 in the second direction D2 is a standby position of the ejectors 42 and 43.

For example, a coil spring 45 obtained by winding a plate formed from an elastic deformable material can be used to store the energy released from the winding spring 86. In this construct, as shown in FIG. 5, a first end portion of the coil spring 45 is fixed to the frame or the like of the sheet post-processing apparatus 21 by a connection member 95. A second end portion of the coil spring 45 is fixed to a first shaft member 96*a*. A first end portion of the first shaft member 96*a* is coaxially connected to a second shaft member 96*b* through a first electromagnetic clutch 97. A second end portion of the first shaft member 96*a* is coaxially connected to a third shaft member 96*c* through a second electromagnetic clutch 98. A fifth support shaft (support shaft) 96 is configured with the first shaft member 96*a*, the second shaft member 96*b*, and the third shaft member 96*c*. The shaft members 96*a*, 96*b*, and 96*c* are disposed by shifting positions of each member along a common axis line C1 on the axis line C1 that extends along a width direction E. The shaft members 96*a*, 96*b*, and 96*c* are rotatably supported on a frame or the like of the sheet post-processing apparatus 21. As the first shaft member 96*a* rotate in the direction F6 around the axis line C1, it can store the elastic energy accumulated in the coil spring 45.

The first electromagnetic clutch 97 selectively switches to one of a torque transmission state and a torque cut-off state. The first electromagnetic clutch 97 in the torque transmission state transmits torque around the axis line C1 between the first shaft member 96*a* and the second shaft member 96*b*, i.e., the shaft members 96*a*, 96*b* are locked together for rotation. The first electromagnetic clutch 97 in the torque cut-off state does not transmit the torque around the axis line C1 between the first shaft member 96*a* and the second shaft member 96*b*, and thus to rotational movement of shaft members 96*a*, 96*b* are independent.

A second electromagnetic clutch 98 selectively switches to one of the torque transmission state and the torque cut-off state. The second electromagnetic clutch 98 in the torque transmission state transmits the torque around the axis line C1 between the first shaft member 96*a* and the third shaft member 96*c*, and thus the first and third shaft members 96*a*, 96*c* are locked together for rotation. The second electromagnetic clutch 98 in the torque cut-off state does not transmit the torque around the axis line C1 between the first shaft member 96*a* and the third shaft member 96*c*, and thus the first and third shaft members 96*a*, 96*c* rotate independently of each other.

As illustrated in FIG. 5, the second switching unit 46 includes a plurality of convex portions or teeth 101, and a first ratchet gear (ratchet gear) 102. The plurality of convex portions 101 are fixed to an inner periphery surface of the ejector belt 66. Each of the convex portions 101 includes a first outer surface approximately perpendicular to the inner surface of the ejector belt 66, and a second outer surface extending form the inner surface of the ejector belt 66 at a shallow angle and terminating at the terminus of the first outer surface distal from the inner surface of the ejector belt 66. Hereinafter, among the plurality of convex portions 101, the convex portions 101 located above the first ratchet gear 102 are referred to as an upper convex portion 101A, and the convex portions 101 located below the first ratchet gear 102 are referred to as a lower convex portion 101B. When the upper convex portion 101A and the lower convex portion 101B are identified without distinction, they are collectively referred to as a convex portion 101.

The first ratchet gear 102 is a spur gear. The first ratchet gear 102 includes a disc shaped gear main body 102*a*, and a plurality of first teeth units (teeth unit) 102*b* formed on an outer periphery surface of the gear main body 102*a*. Each of the first teeth units 102*b* includes an outer surface along a circumferential direction around the axis line C1, and an outer surface approximately intersecting the circumferential direction. The first ratchet gear 102 is coaxially fixed to the second shaft member 96*b*. Each of the first teeth units 102*b* is engageable with one of the convex portions 101.

With respect to the first ratchet gear 102, when the upper convex portion 101A is moved in the second direction D2 (lower convex portion 101B is moved to first direction D1), by engaging the convex portions 101 to a plurality of first teeth units 102*b*, the first ratchet gear 102 rotates in the direction F5 around the axis line C1. When the first ratchet gear 102 rotates in the direction F5 around the axis line C1, and the first electromagnetic clutch 97 is in the torque transmission state, elastic energy is accumulated in the coil spring 45. The coil spring 45 accumulates the elastic energy discharged from the winding spring 86 as elastic energy. The plurality of convex portions 101 interlock with the ejector 42 through the ejector belt 66.

With respect to the first ratchet gear 102, when the upper convex portion 101A is moved in the first direction D1 (and thus the lower convex portion 101B is moved in the second direction D2), the first ratchet gear 102 is not rotated around the axis line C1 because the convex portions 101 do not engage with the plurality of first teeth units 102*b*, but simply slip past the first teeth units 102*b*. The second switching unit 46 causes energy transmission from the ejector 42 to the coil spring 45 when the ejector 42 and the upper convex portion 101A are move in the second direction D2. The second switching unit 46 prevents energy transmission between the ejector 42 and the coil spring 45, when the ejector 42 and the upper convex portion 101A are moved in the first direction D1.

The number of the convex portions 101 provided in the ejector belt 66 is not limited to a plurality, and may be also one. The number of the first teeth units 102*b* formed in the gear main body 102*a* is not limited to a plurality, and may be also one.

The second drive unit 47 includes the described-above fifth support shaft 96, a third switching unit 105, and a movement conversion unit 106. The third switching unit 105 includes a second ratchet gear 108, a pawl 109, and a solenoid 110. The second drive unit controls the positioning of the lateral alignment plates 49 using the energy stored in the coil spring 45 to move.

The second ratchet gear 108 includes a disc type gear main body 108*a* and a plurality of second teeth units 108*b* formed on an outer periphery surface of the gear main body 108*a*. Each of the second teeth units 108*b* includes an outer surface along the circumferential direction around the axis line C1, and an outer surface approximately intersecting the circumferential direction. The second ratchet gear 108 is coaxially fixed to the first shaft member 96*a*.

The pawl 109 is formed in a rod shape. The pawl 109 is pivotally supported at an intermediate portion along the longitudinal direction thereof, to be pivoted about an axis line C2 along the width direction E by a pivot pin or other fixed connection to the frame or the like of the sheet post-processing apparatus 21.

The solenoid 110 includes a main body 110*a* and a plunger 110*b*. For example, when a voltage is not applied to the main body 110*a*, the plunger 110*b* is at its furthest extension form the main body 110*a*. If the plunger 110*b* pushes up on the first end portion of the pawl 109, a second end portion of the pawl 109 is lowered. The second end portion of the pawl 109 is thus locked in the second teeth unit 108*b* of the second ratchet gear 108, preventing rotation of the second ratchet gear 108 in direction F6. The pawl 109 and second ratchet gear 108 regulate the rotation of the fifth support shaft 96 in the direction F6 around the axis line C1.

When a voltage is applied to the main body 110*a*, the plunger 110*b* is pulled inwardly of the main body 110*a*. When the plunger 110*b* pulls down on the first end portion of the pawl 109, the second end portion of the pawl 109 moves in an upward direction. When the second end portion of the pawl 109 is moved to the position P2, locking of the second end portion of the stopper 109 and the second teeth unit 108*b* of the second ratchet gear 108 is released. The second ratchet gear 108 can thus be rotated in either the direction F5 or the direction F6 around the axis line C1. The third switching unit 105 is thus in a movement state in which the pair of lateral alignment plates 49, one of each connected to one of the racks 116, 117, is moved by the elastic energy accumulated in the coil spring 45. The third switching unit 105 of the movement state also moves the first shaft member 96*a* in either direction around the axis line C1. However, by selective engagement or disengagement of the electromagnetic clutches 97, and 98 to lock or free shafts 96*a*, 96*b*, and 96*c*, the lateral alignment plates can be moved without affecting the positioning of the ejectors 42, 43, by putting the electromagnetic clutch 97 in the torque cut off state and the electromagnetic clutch 98 in the torque transmission state.

As described above, the third switching unit 105 is selectively switched to one of the movement state and the fixed state.

To enable the third switching unit 105 to control the pair of lateral alignment plates 49, the movement conversion unit 106 includes a first bevel gear 113, a second bevel gear 114, a pinion gear 115, and racks 116 and 117.

The first bevel gear 113 is attached to the third shaft member 96*c*. The first bevel gear 113 rotates around the axis line C1.

The second bevel gear 114 rotates around an axis line C3 along an intersection direction perpendicular to (intersecting) the transportation direction D and the width direction E. The second bevel gear 114 meshes with the first bevel gear 113. The pinion gear 115 is fixed to the second bevel gear 114. The pinion gear 115 coaxially rotates with the second bevel gear 114.

Each of racks 116 and 117 extends in the width direction E, and is disposed to contact the pinion gear 115 therebetween in the transportation direction D. Each of racks 116 and 117 meshes with the pinion gear. One lateral alignment plate 49 is attached to one of each of the racks 116 and 117.

The second bevel gear 114 is rotatably supported around the axis line C3 on the frame or the like of the sheet post-processing apparatus 21. The racks 116 and 117 are movably supported in the width direction E.

The coil spring 45 and the second drive unit 47 configured as described above operate as follows.

It is assumed that the second electromagnetic clutch 98 is in the torque transmission state, and the third switching unit 105 is in the movement state. The coil spring 45 rotates the first shaft member 96*a* in the direction F6 around the axis line C1 using the elastic energy stored therein. The third shaft member 96*c* connected to the first shaft member 96*a* by the electromagnetic clutch 97 in the torque transmission state and the first bevel gear 113 rotate in the direction F6 around the axis line C1. The second bevel gear 114 and the pinion gear 115 rotate in the direction F7 around the axis line C3. The rack 116 is moved in the direction E1 of the width direction E. When the rack 116 is moved in the direction E1, the lateral alignment plate 49 attached to the rack 116 is moved to the direction E1. The rack 117 is moved in the direction E2 of the width direction E. When the rack 117 is moved in the direction E2, the lateral alignment plate 49 attached to the rack 117 is moved in the direction E2. Thus the pair of lateral alignment plates 49 are separated from each other.

The movement conversion unit 106 moves the pair of lateral alignment plates 49 by rotating the pinion gear 115 around the axis line C1 of the first shaft member 96*a*. The second drive unit 47 moves the pair of lateral alignment plates 49 using the elastic energy accumulated in the coil spring 45.

A third bevel gear 120 meshes with the second bevel gear 114. The third bevel gear 120 is rotatably supported around the axis line C4 in parallel with the axis line C1. A sixth support shaft 122 is coaxially connected to the third bevel gear 120 through a third electromagnetic clutch 121. The third electromagnetic clutch 121 is selectively switched to the torque transmission state or the torque cut-off state. The third electromagnetic clutch 121 in the torque transmission state transmits torque around the axis line C4 between the third bevel gear 120 and the sixth support shaft 122. The third electromagnetic clutch 121 in the torque cut-off state does not transmit torque around the axis line C4 between the third bevel gear 120 and the sixth support shaft 122.

The sixth support shaft 122 rotates around the axis line C4 by interlocking with a drive shaft of a movement motor 123 (see FIG. 2).

The third bevel gear 120, the third electromagnetic clutch 121, the sixth support shaft 122, and the movement motor 123 configured as described above are operated as follows.

It is assumed that the third electromagnetic clutch 121 is in the torque transmission state, and the second electromagnetic clutch 98 is in the torque cut-off state. By driving the movement motor 123, the sixth support shaft 122 and the third bevel gear 120 rotate in the direction F9 around the axis line C4. As a result, the second bevel gear 114 and the pinion gear 115 rotate in the direction F8 around the axis line C3. The rack 116 and the lateral alignment plate 49 attached to the rack 116 are moved in the direction E2 of the width direction E. The rack 117 and the lateral alignment plate 49 attached to the rack 117 are moved in the direction E1 of the width direction E. As a result, the pair of lateral alignment plates 49 are brought close to each other.

As the pair of lateral alignment plates 49 are brought close together, the first bevel gear 113 and the third shaft member 96*c* rotate in the direction F5 around the axis line C3. However, since the second electromagnetic clutch 98 is in the torque cut-off state, the torque of the third shaft member 96*c* is not transmitted to the first shaft member 96*a*.

As illustrated in FIG. 3, the processing tray 48 is inclined with respect to a horizontal direction so as to gradually be higher toward the downstream side of the sheet discharge path.

A pair of lateral alignment plates 49 is provided on an upper surface of the processing tray 48. The pair of lateral alignment plates 49 are provided to pinch the plurality of sheets S supported on the processing tray 48 in the width direction and thus bring their sides into close alignment.

The stapler 50 performs stapling (binding) on a bundle of the plurality of sheets S supported on the processing tray 48. The discharge roller 51 is provided in an end portion of the downstream side of the processing tray 48. The discharge roller 51 discharges the plurality of sheets S supported on the processing tray 48 toward the movable tray 24*b* of the sheet discharging tray unit 24.

As illustrated in FIG. 2, the post-processing control unit 25 includes a main control unit 126, a position detection unit (detection unit) 127, a switching control unit (control unit) 128, and an electrical power supply unit 129.

For example, the main control unit 126, the position detection unit 127, and the switching control unit 128 are configured similar to the above-described image forming control unit 17.

The position detection unit 127 detects a position of the bundle hook 41. The position detection unit 127 includes a counter that counts the number of pulses. The bundle hook 41 being at the retraction position P1 is moved around the bundle hook belt 55 according to a pulse signal generated from the motor driver 69. There is a certain relationship between the number of pulses of the pulse signal and position of the bundle hook 41. The position detection unit 127 detects the position of the bundle hook 41 by counting the number of pulses of the pulse signal.

Figure 7:
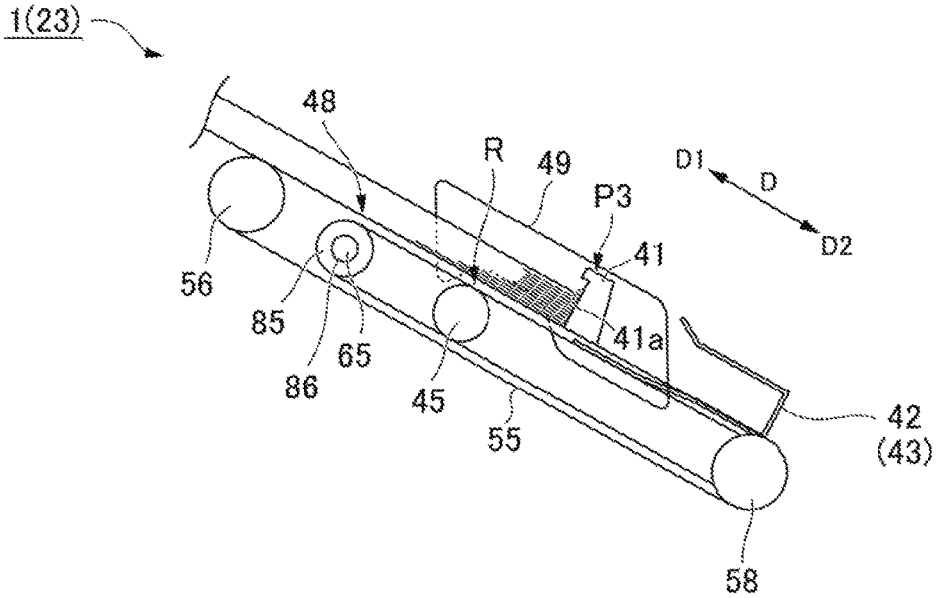
FIG. 7 is a partial view of the post processing apparatus, showing the bundle hook engaged against a stack of sheets and the ejectors in a retracted position.
Figure 8:
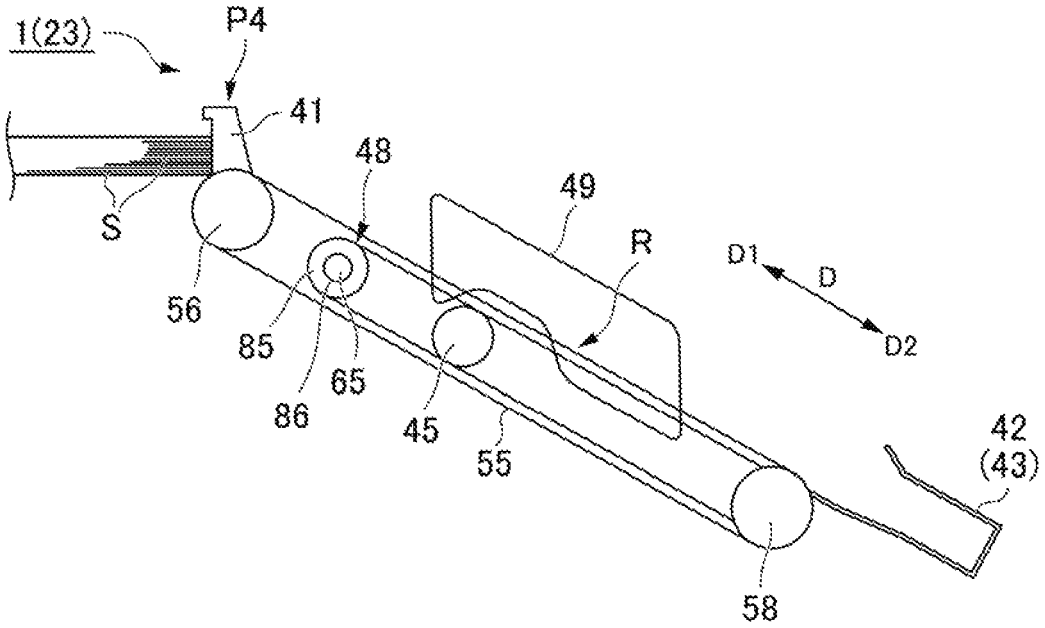
FIG. 8 is a partial view of the post processing apparatus, showing the bundle hook positioned to deliver a stack of sheets to a discharge roller and the ejector returned to the position thereof of FIG. 6.

For example, the position detection unit 127 detects a position under the bundle hook 41. The detected one position is a first position P3 in which the bundle hook 41 receives the sheet S from the ejectors 42 and 43 on the transportation path R, illustrated in FIG. 7. The first position P3 can be obtained from a waiting position described below or moving speed of the bundle hook 41, and the ejectors 42 and 43. The detected other position is a second position P4 that is an end in the first direction D1 to which the bundle hook 41 is moved on the transportation path R, as illustrated in FIG. 8.

When it is detected that the bundle hook 41 is disposed at the first position P3 and at the second position P4, the position detection unit 127 sends a detection result to a switching control unit 128.

The switching control unit 128 controls the solenoid 110 of the third switching unit 105.

When the position detection unit 127 detects that the third switching unit 105 is in the fixed state and the bundle hook 41 is disposed at the second position P4, the switching control unit 128 switches the third switching unit 105 to the movement state to separate the alignment plates 49.

The main control unit 126 performs overall control relating to the sheet post-processing apparatus 21, other than control performed by the switching control unit 128. The main control unit 126 controls a motor driver 69, electromagnetic clutches 97, 98, and 121, the movement motor 123, the clutch mechanism 64, the solenoid 110, and the like.

The electrical power supply unit 129 converts an AC voltage supplied to the sheet post-processing apparatus 21 into a DC voltage, and supplies the converted DC voltage to the motor driver 69 and the like.

Figure 6:
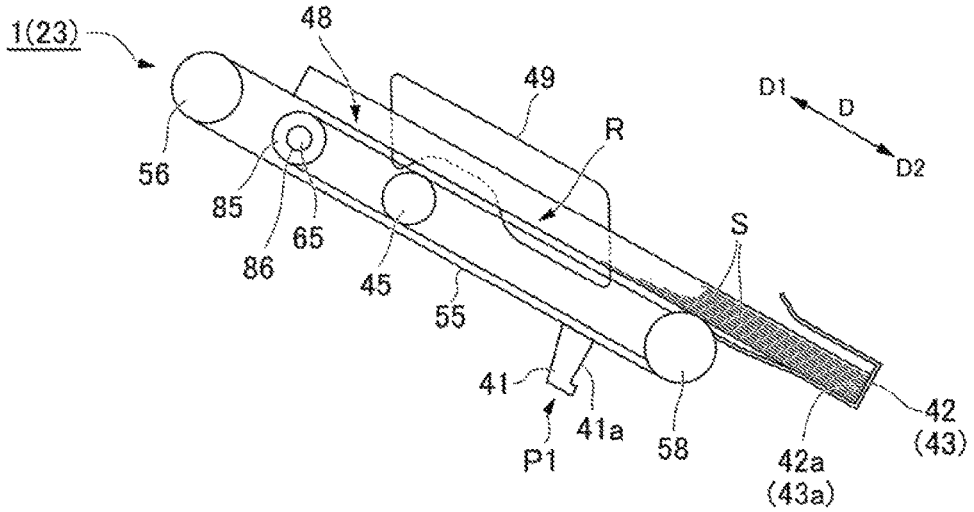
FIG. 6 is a partial view of the post processing apparatus, showing the respective positions of the bundle hook and an ejector of the post processing apparatus system of the embodiment wherein the bundle hook is in a fully retracted position.

Next, an operation of the image forming system 1 configured as described above will be described based on an operation of the processing unit 23 of the sheet post-processing apparatus 21. In advance, it is assumed that there is a following condition. As illustrated in FIG. 6, the ejectors 42 and 43 are at the standby position. By rotating the bundle hook belt 55, the bundle hook 41 is at the retraction position P1. The clutch mechanism 64 is in the power interlocking state. The electromagnetic clutches 97 and 121 are in the torque transmission state, and the second electromagnetic clutch 98 is in the torque cut-off state. The third switching unit 105 is in the fixed state. The pair of lateral alignment plates 49 are separated from each other in the width direction.

A user starts the image forming system 1 by operating the control panel 12. For example, a user selects the movable tray 24*b* as a discharge destination of the sheet S by operating the control panel 12. In the sheet post-processing apparatus 21, the DC voltage is supplied from the electrical power supply unit 129 to the motor driver 69 or the like.

The image forming apparatus 11 transports the sheet S on which a toner image is formed from the sheet supply port 35 toward an inside of the sheet post-processing apparatus 21.

The sheet post-processing apparatus 21 transports the sheet S through the second transportation path 32. The plurality of sheets S are supported on the pair of standby trays 36. As illustrated in FIG. 6, the plurality of sheets S are transported to the processing tray 48 that is the transportation path R. The plurality of sheets S are held in the concave portions 42*a* and 43*a* of the ejectors 42 and 43. The main control unit 126 causes the pair of lateral alignment plates 49 to come close together by driving the movement motor 123 described above. Since the second electromagnetic clutch 98 is in the torque cut-off state, even when the movement motor 123 is driven, the ejectors 42 and 43 are not moved.

The plurality of sheets S are aligned by the pair of lateral alignment plates 49. The stapler 50 is driven such that stapling is appropriately performed on the stack of sheets.

The main control unit 126 actuates the drive motor 62 to rotate the drive shaft 62*b* in the direction F1 (see FIG. 4) (feeding process S1 of ejector and bundle hook). The main control unit 126 switches the third electromagnetic clutch 121 to the torque cut-off state.

By interlocking with the drive shaft 62*b*, a drive belt 76, the third support shaft 63, a drive belt 79, and the rollers 56 and 77 that are now integrally implemented rotate. Since the clutch mechanism 64 is in the power interlocking state, the fourth support shaft 65 rotates in the direction F3 by interlocking with rotation of the third support shaft 63. By rotating the ejector belts 66 and 67, the ejectors 42 and 43 are moved to the first direction D1, as illustrated in FIG. 7. As a result, the winding spring 86 is wound tight, and elastic energy is accumulated in the winding spring 86. The plurality of sheets S are moved to the first direction D1, while being guided along their sides by a pair of lateral alignment plates 49. The sheet post-processing apparatus 21 includes the second switching unit 46 such that energy transmission from the ejector 42 to the coil spring 45 is blocked. That is, the fifth support shaft 96 is not rotated around the axis line C1.

By being interlocked with the rotation of the roller 56 and operation of the drive motor 62, the bundle hook belt 55 and the bundle hook 41 rotate. The bundle hook 41 is initially moved in the second direction D2 on the downwardly facing surface of the bundle hook belt 55, and then moved in the first direction D1 as the portion of the bundle hook belt 55 supporting it moves to an upwardly facing position.

In this manner, the driving force of the drive motor 62 is transmitted in the order of the drive belt 76, the third support shaft 63, the clutch mechanism 64, the fourth support shaft 65, and the ejector belts 66 and 67. The ejectors 42 and 43 are moved in the first direction D1. The driving force of the drive motor 62 is transmitted in the order of the drive belt 76, the third support shaft 63, the drive belt 79, and the bundle hook belt 55. The bundle hook 41 rotates around the bundle hook belt 55. The drive motor 62 generates driving force for moving the ejectors 42 and 43 to the first direction D1.

By sizing of the different rollers, the movement speed of the bundle hook 41 is faster than the movement speed of the ejectors 42 and 43. As illustrated in FIG. 7, the bundle hook 41 receives the plurality of sheets S from the ejectors 42 and 43 at the first position P3 on the transportation path R. The plurality of sheets S are held in the concave portion 41*a* of the bundle hook 41.

In the feeding process S1 of the ejector and the bundle hook, the main control unit 126 moves the ejectors 42 and 43 and the bundle hook 41 in the first direction D1 on an upwardly facing surface of the ejector belts 66 and 67 and bundle hook belt 55.

When it is detected that the bundle hook 41 is at the first position P3, the position detection unit 127 sends a detection result to the switching control unit 128 (returning process S3 of ejector). The main control unit 126 switches the clutch mechanism 64 to the power release state. When the clutch mechanism 64 is in the power release state, even though the third support shaft 63 rotates, the driving force transmitted to the third support shaft 63 is not transmitted to the fourth support shaft 65.

The winding spring 86 discharges its accumulated elastic energy. The fourth support shaft 65 rotates in the direction F4. The ejectors 42 and 43 are moved in the second direction D2. When the clutch mechanism 64 is in the power release state, the interlocking of the drive motor 62 and the ejectors 42 and 43 is released. By setting the clutch mechanism 64 in the power release state, the drive motor 62 will not prevent the movement of the ejectors 42 and 43 in the second direction D2. The ejectors 42 and 43 are moved in the second direction D2 by the elastic energy of the winding spring 86. As illustrated in FIG. 8, the ejectors 42 and 43 return to the waiting position.

The first electromagnetic clutch 97 is in the torque transmission state, and the second electromagnetic clutch 98 is in the torque cut-off state. The shaft members 96*a* and 96*b* integrally implemented rotate in the direction F5 around the axis line C1 together with the ratchet gears 102 and 108, and the second end portion of the coil spring 45. The elastic energy is accumulated in the coil spring 45. When the ejectors 42 and 43 rotate in the second direction D2, the elastic energy accumulated in the winding spring 86 is transmitted to the coil spring 45 through the second switching unit 46. Even though the shaft members 96*a* and 96*b* rotate, the third shaft member 96*c* is not rotated. The pair of lateral alignment plates 49 is not moved.

Meanwhile, even after the clutch mechanism 64 is switched to the power release state, the bundle hook 41 is moved in the first direction D1 on the upward surface of the bundle hook belt 55. The bundle hook 41 reaches the second position P4 that is an end in the first direction D1 on the upward surface of the bundle hook belt 55. The bundle hook 41 pushes the plurality of sheets S from above of the processing tray 48 in the first direction D1. The discharge roller 51 discharges the pushed plurality of sheets S to the movable tray 24*b*.

In the returning process S3 of the ejector, the main control unit 126 causes the ejectors 42 and 43 to move in the second direction D2 on the ejector belts 66 and 67, and return to the waiting position.

When it is detected that the bundle hook 41 is disposed at the second position P4, the position detection unit 127 sends a detection result to the switching control unit 128 (returning process S5 of bundle hook). The switching control unit 128 switches the third switching unit 105 to the movement state. The main control unit 126 switches the first electromagnetic clutch 97 to the torque cut-off state, and switches the second electromagnetic clutch 98 to the torque transmission state.

When the third switching unit 105 is in the movement state, the first shaft member 96*a* and the third shaft member 96*c* rotate in the direction F6 around the axis line C1, by the elastic energy accumulated in the coil spring 45. As described above, the first bevel gear 113 rotates in the direction F6 around the axis line C1, and the pair of lateral alignment plates 49 are separated from each other. When the first electromagnetic clutch 97 is in the torque cut-off state, even though the first shaft member 96*a* rotates, the ejector belt 66 is not moved.

The main control unit 126 rotates the drive shaft 62*b* of the drive motor 62 in the direction F2 (see FIG. 4), by driving the motor driver 69. By interlocking with the drive shaft 62*b*, the drive belt 76, the third support shaft 63, the drive belt 79, and the bundle hook belt 55 rotate. The bundle hook 41 is moved in the second direction D2 on the upwardly facing surface of the bundle hook belt 55. The bundle hook 41 is moved in the first direction D1 as the portion of the bundle hook belt 55 supporting it becomes downwardly facing. Thus, the bundle hook 41 is returned to the retraction position P1. Since the clutch mechanism 64 is in the power release state, even though the third support shaft 63 rotates, the ejector belts 66 and 67 are not rotated.

The switching control unit 128 switches the third switching unit 105 to the fixed state. The main control unit 126 switches the clutch mechanism 64 to the power interlocking state. The main control unit 126 switches the electromagnetic clutches 97 and 121 to the torque transmission state, and switches the second electromagnetic clutch 98 to the torque cut-off state.

In the returning process S5 of the bundle hook, the main control unit 126 returns to the retraction position P1, by moving the bundle hook 41 in the second direction D2 when the portion of the bundle hook belt 55 forms the upper surface of the bundle hook belt 55.

The post-processing control unit 25 combines and repeats the feeding process S1 of the ejector and the bundle hook, the returning process S3 of the ejector, and the returning process S5 of the bundle hook described above.

As described above, the sheet post-processing apparatus of the embodiment includes the coil spring 45 for accumulating the elastic energy discharged from the winding spring 86. Accordingly, it is possible to effectively use the elastic energy accumulated in the winding spring 86 without waste.

The first drive unit 44 includes the drive motor 62 and the clutch mechanism 64. When the ejectors 42 and 43 are moved to the second direction D2, the clutch mechanism 64 is in the power release state. Since the ejectors 42 and 43 are moved in the second direction D2, it is unlikely that the drive motor 62 becomes an obstacle.

The sheet post-processing apparatus 21 includes the second switching unit 46. Only when the ejectors 42 and 43 are moved to the second direction D2, it is possible to transmit the elastic energy from the ejectors 42 and 43 to the coil spring 45.

The sheet post-processing apparatus 21 includes the second drive unit 47. It is possible to move the pair of lateral alignment plates 49 using the elastic energy accumulated in the coil spring 45.

The second drive unit 47 includes the third switching unit 105. By switching the third switching unit 105 to the movement state at a desired timing for moving the pair of lateral alignment plates 49, it is possible to move the pair of lateral alignment plates 49.

The sheet post-processing apparatus 21 includes the switching control unit 128, the bundle hook 41, and the position detection unit 127. When the position detection unit 127 detects that the bundle hook 41 is disposed at the second position P4, the switching control unit 128 switches the third switching unit 105 to the movement state. With this, it is possible to dispose the bundle hook 41 at the second position P4, and move the pair of lateral alignment plates 49 to be separated from each other.

The energy storage unit is the coil spring 45. By a simple configuration referred to as the coil spring 45, it is possible to store the elastic energy discharged from the winding spring 86. In the embodiment, the energy storage unit is the coil spring 45.

The sheet post-processing apparatus 21 may also supply electrical energy stored in the energy storage unit to the motor driver 69 or the like without including the third switching unit 105.

In the embodiment, when the position detection unit 127 detects that the bundle hook 41 is disposed at the second position P4, the switching control unit 128 switches the third switching unit 105 to the movement state. Accordingly, when the position detection unit 127 detects that the bundle hook 41 is disposed at the retraction position P1 after the bundle hook 41 returns to the second position P4, the switching control unit 128 may also switch the third switching unit 105 to the movement state.

The pair of lateral alignment plates 49 can be brought close to each other by one movement motor 123. However, each of the lateral alignment plates 49 may also include a dedicated movement motor 123 for moving the lateral alignment plate 49.

The sheet post-processing apparatus 21 may be also configured with the fifth support shaft 96 in which the shaft members 96*a*, 96*b*, and 96*c* are integrally implemented without including the electromagnetic clutches 97 and 98.

According to at least one embodiment described above, by implementing the coil spring 45, it is possible to effectively use the elastic energy accumulated in the winding spring 86 without waste.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet processing apparatus for a multi-function peripheral, comprising;

a sheet transport path;

at least one sheet holder moveable between a rest position and a sheet hand-off position distal in the sheet travel path direction from the rest position;

a bundle hook moveable between a retracted position, a second sheet hand-off position, and an extended position distal in the sheet travel path direction from the sheet hand-off position;

at least one sheet aligner movable between an extended position, wherein the at least one sheet aligner is contactable against a sheet in the sheet transport path, and a retracted position wherein the aligner is spaced from a location of any sheet in the sheet transport path;

a first drive element configured to move the at least one sheet holder from the rest position to the sheet hand-off position; and at least one energy storage element selectively operatively connected to the first drive element and capable of storing energy as the sheet holder is moved by the first drive element from the rest position to the sheet hand-off position, wherein the energy storage element selectively discharges the energy stored therein to move the sheet holder from the sheet hand-off position to the rest position after the bundle hook is moved from the retracted position to the second sheet hand-off position.

2. The sheet processing apparatus of claim 1, wherein a second energy storage element is selectively operatively coupled to the energy storage element and the at least one aligner, and the second energy storage element selectively discharges the energy stored therein to move the sheet aligner from the extended position to the retracted position.

3. The sheet processing apparatus of claim 2, further comprising:

a first belt supported on opposed first and second rollers, the sheet holder mounted to the first belt; and a second belt supported on opposed third and fourth rollers, the bundle hook mounted to the first belt, wherein the second belt is operatively connected to the first drive element and the first belt is selectively operatively coupled to the first drive element.

4. The sheet processing apparatus of claim 3, further comprising:

a first clutch selectively positionable to couple the first belt and the first drive element.

5. The sheet processing apparatus of claim 3, further comprising:

a first shaft;

a second shaft selectively connectable to the first shaft by a second clutch; and a third shaft selectively engageable with the second shaft by a third clutch, wherein the second energy storage element is connected to the second shaft;

the first shaft is operatively connected to the first belt; and the second clutch is operable to selectively operatively couple, or decouple, the first shaft and the second shaft.

6. The sheet processing apparatus of claim 5, wherein the third shaft is connected to a movement motor.

7. The sheet processing apparatus of claim 6, wherein a fourth shaft is selectively connectable to the movement motor and the third shaft by a fourth clutch.

8. The sheet processing apparatus of claim 7, wherein the fourth clutch is electromagnetic.

9. The sheet processing apparatus of claim 7, wherein the fourth clutch regulates torque being transmitted from the third shaft to the fourth shaft.

10. The sheet processing apparatus of claim 5, wherein the third shaft is operatively coupled to the sheet aligner, and the third clutch is operable to selectively couple, or decouple, the second shaft and the third shaft.

11. The sheet processing apparatus of claim 10, wherein the operative coupling of third shaft and the sheet aligner comprises a rack and pinion coupling.

12. The sheet processing apparatus of claim 10, further comprising:

a switch interconnected to the second shaft, the switch operable in a first position to allow rotation of the second shaft in a first rotational direction but limit rotation of the second shaft in a second rotational direction opposed to the first rotational direction, and a second position wherein the second shaft may rotate in either of the first or second rotational directions.

13. The sheet processing apparatus of claim 12, wherein:

the sheet aligner is moved from the extended position to the retracted position when the second clutch decouples the first shaft from the second shaft, the third clutch couples the second shaft to the third shaft, and the switch is in the second position.

14. The sheet processing apparatus of claim 13, wherein the switch comprises a ratchet gear mounted around the second shaft, a solenoid, and a pawl selectively moveable by the solenoid to move the pawl to move the switch between the first position and the second position.

15. The sheet processing apparatus of claim 14, wherein at least one of the second clutch and the third clutch are electromagnetic clutches.

16. The sheet processing apparatus of claim 1, wherein the energy storage element comprises a spring.

17. The sheet processing apparatus of claim 1, further comprising a switching control unit that is configured to control movement of the at least one sheet aligner from the extended position to the retracted position.

18. The sheet processing apparatus of claim 17, further comprising a position detection unit, wherein the position detection unit detects a position of the bundle hook.

19. The sheet processing apparatus of claim 18, wherein the position detection unit is configured to send the position of the bundle hook to the switching control unit.

20. The sheet processing apparatus of claim 19, wherein the switching control unit moves the at least one sheet aligner based on position of the bundle hook.

* * * * *